US007973257B2

(12) United States Patent
Faifer

(10) Patent No.: US 7,973,257 B2
(45) Date of Patent: Jul. 5, 2011

(54) ROCKER SWITCH WITHIN A DEVICE HOLDER

(76) Inventor: Sagi Faifer, Mishmar Hashiva (IL)

( * ) Notice: Subject to any disclaimer, the term of this patent is extended or adjusted under 35 U.S.C. 154(b) by 213 days.

(21) Appl. No.: 12/325,290

(22) Filed: Dec. 1, 2008

(65) Prior Publication Data

US 2009/0139846 A1 Jun. 4, 2009

Related U.S. Application Data

(60) Provisional application No. 60/990,922, filed on Nov. 29, 2007.

(51) Int. Cl.
*H01H 15/00* (2006.01)

(52) U.S. Cl. ..... 200/561; 362/110

(58) Field of Classification Search ..... 200/561, 200/336, 529, 330; 42/123, 117; 362/110
See application file for complete search history.

(56) References Cited

U.S. PATENT DOCUMENTS

| | | | | |
|---|---|---|---|---|
| 5,207,316 | A * | 5/1993 | Sakamoto | 200/47 |
| 2004/0057720 | A1 * | 3/2004 | Westerweck et al. | 396/448 |
| 2005/0023121 | A1 * | 2/2005 | Jin | 200/336 |
| 2007/0277422 | A1 * | 12/2007 | Ding | 42/146 |

* cited by examiner

*Primary Examiner* — Edwin A. Leon
*Assistant Examiner* — Vanessa Girardi
(74) *Attorney, Agent, or Firm* — Deborah Gador

(57) ABSTRACT

A rocker switch including a base, a rotary to linear converter mounted on the base, the rotary to linear converter being rotatable by means of at least one knob, and an actuating assembly mounted on the rotary to linear converter and arranged to actuate an electric device when the knob is rotated.

15 Claims, 8 Drawing Sheets

ROCKER SWITCH WITHIN A DEVICE HOLDER

FIELD OF THE INVENTION

The present invention relates to rocker switches, in general, and to a device or accessory holder for mounting on a handgun or other instrument having a mounting rail.

BACKGROUND OF THE INVENTION

A rocker switch is an on/off switch that rocks (rather than trips) when pressed, which means one side of the switch is raised while the other side is depressed much like a rocking horse rocks back and forth. Rocker switches are known for a variety of functions, such as surge protectors, display monitors, computer power supplies, and many other devices and applications.

Accessory holders for holding an accessory, such as a flashlight or a laser pointer, for mounting on a firearm, have long been known. Activation or deactivation of an accessory, when in the holder, typically requires a button or actuator on one side of the firearm or in the handle, for activating the accessory. However, these actuators are in a fixed location and cannot be adjusted for different users.

Accordingly, there is a long felt need for an accessory actuator providing flexible actuation and it would be desirable to have such an actuator which can be mounted in an accessory holder for easy access by a user.

SUMMARY OF THE INVENTION

The present invention relates to a rocker switch particularly for mounting in an accessory holder for firearms, cameras, and other similar devices requiring accessories. The accessory holder can be mounted directly on the device or, alternatively, it may be mounted on a standard mounting rail, such as a Weaver or Picatinny Rail, or any other rail complementary to the device's mounting rail.

There is thus provided, in accordance with the present invention, a rocker switch including a base, a rotary to linear converter mounted on the base, the rotary to linear converter being rotatable by means of at least one knob, and an actuating assembly mounted on the rotary to linear converter and arranged to actuate an electric device when the knob is rotated.

According to one embodiment of the invention, the rotary to linear converter includes an angled portion which defines a projecting ridge of substantially triangular cross-section and the actuating assembly defines a groove complementary to the projecting ridge.

According to another embodiment of the invention, the actuating assembly includes a hinge arm coupled to the base, defining a pivot.

There is further provided, according to the invention, an accessory holder including a rocker switch, wherein the rocker switch includes a base, a rotary to linear converter mounted on the base, the rotary to linear converter being rotatable by means of at least one knob, and an actuating assembly mounted on the rotary to linear converter and arranged to actuate an electric device when the knob is rotated.

There is also provided, according to the invention, a method for forming a rocker switch, the method including providing a base, mounting a rotary to linear converter on the base, the rotary to linear converter being rotatable by means of at least one knob, and mounting an actuating assembly on the rotary to linear converter, the actuating assembly being arranged to actuate an electric device when the knob is rotated.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a mechanical rocker switch for turning a device actuated by a push button on and off. The rocker switch can be mounted in, or form an integral part of, an accessory holder for activating or deactivating a device placed in the holder, such as a flashlight or a laser pointer. The holder can be mounted on various tools, for example handguns, cameras, etc, particularly those having a mounting rail.

Figure 1:
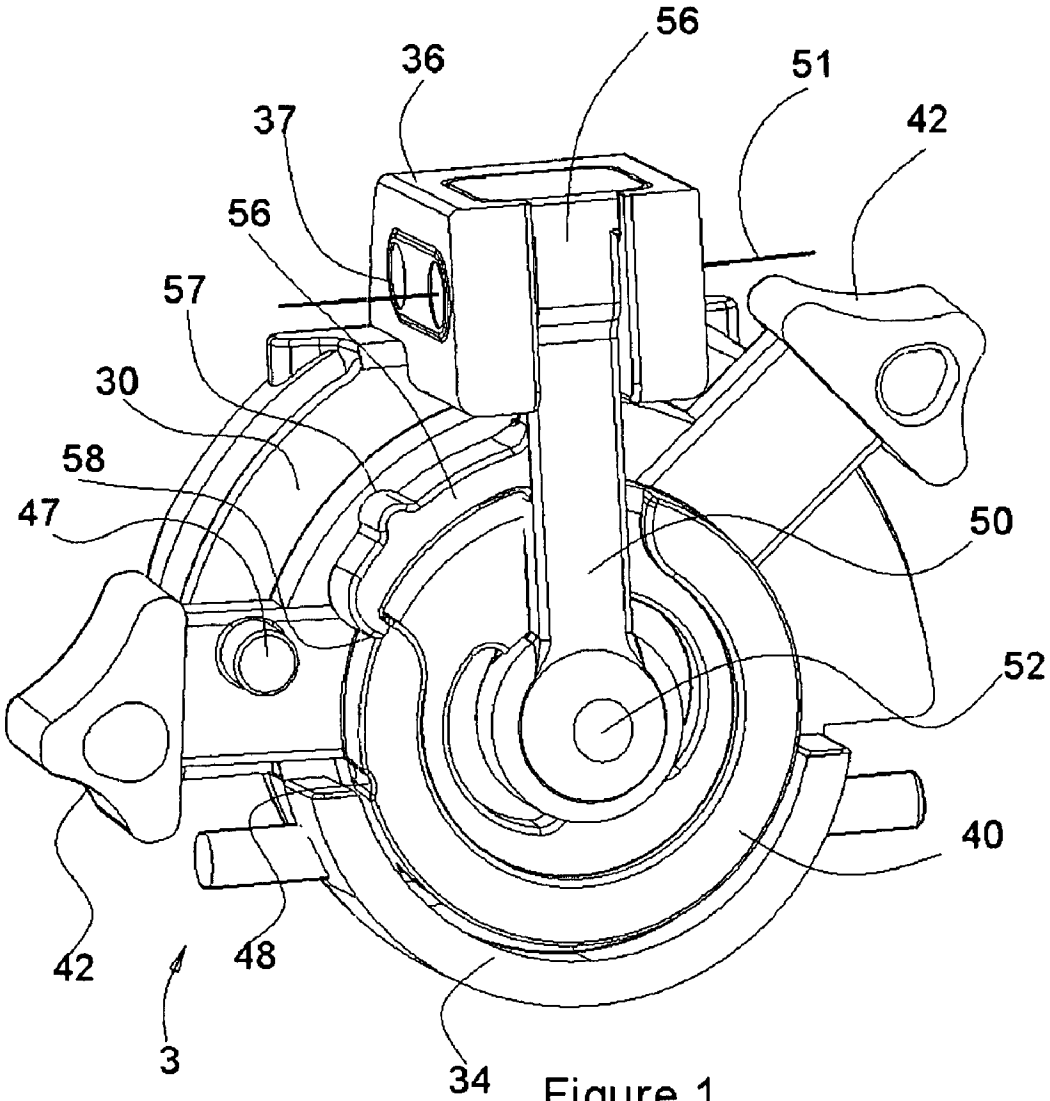
FIG. 1 is a perspective view of a rocker switch constructed and operative in accordance with one embodiment of the present invention.

FIG. 1 is a perspective view of a rocker switch 3 according to one embodiment of the invention. Rocker switch 3 converts a rotary movement to a linear movement, which can be used for pressing a standard push button. Rocker switch 3 includes a base 30, a rotary to linear motion converter 40 and an actuating assembly 50. Converter 40 is substantially circular with at least one and preferably two knobs which can be used to rotate converter 40. As knob 42 is rotated, actuating assembly 50 pivots outwards about a pivot axis 51. On the outermost part of actuating assembly 50, there is a knob 52, disposed so as to selectively press or release a rear button or switch of the accessory adjacent to knob 52, as it moves outward or inward.

This preferred embodiment of rocker switch 3 allows three positions: "on", "off", and "momentary on-off". FIG. 1 is an illustration of rocker switch 3 in an off position. Actuating assembly 50 is in its non-pivoted position. In this position no pressure is applied to the switch of the device adjacent to knob 52.

Figure 2:
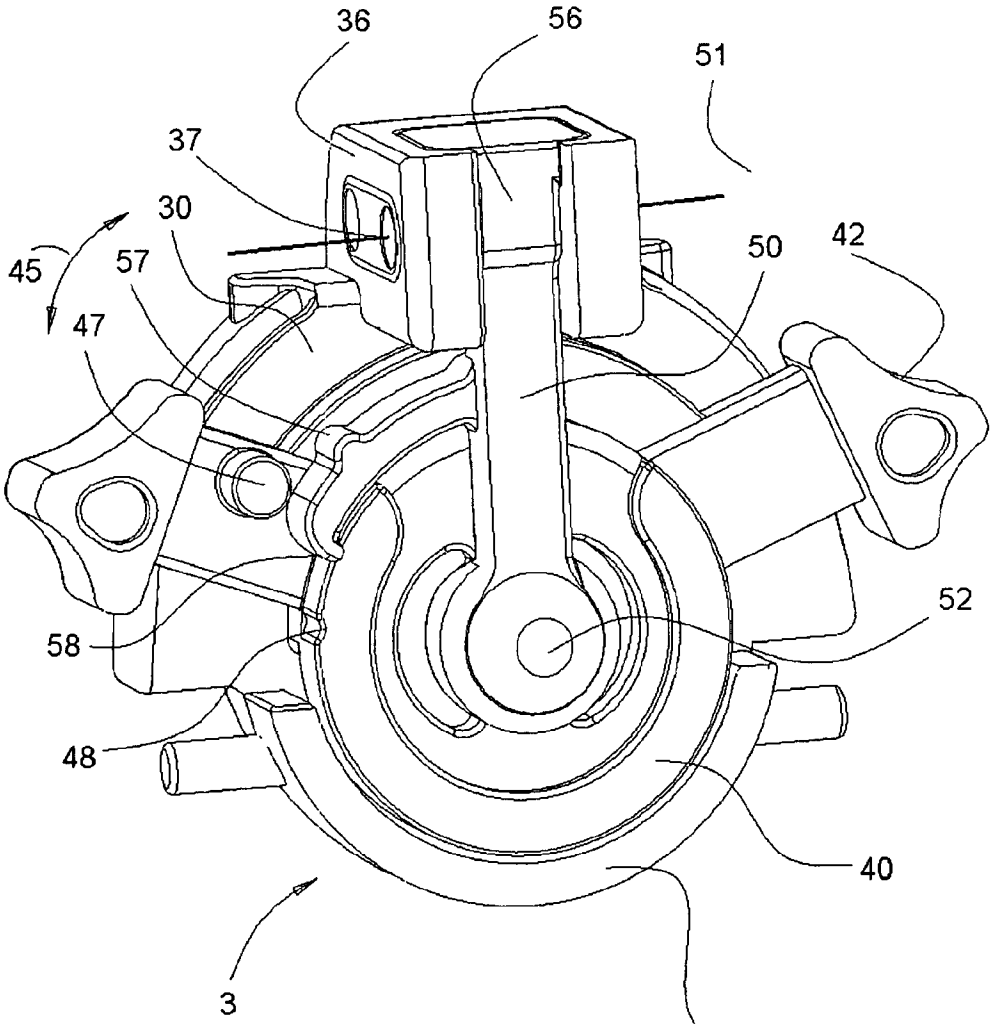
FIGS. 2 and 3 are perspective views of the rocker switch of FIG. 1 in two different positions of operation.

FIG. 2 illustrates rocker switch 3 in a momentary on-off position. As converter 40 is rotated, its rotary motion is converted to linear motion, and actuating assembly 50 is pivoted about axis 51, whereby knob 52 engages an actuating on-switch adjacent to it. Rocker switch 3 may include a spring or other mechanism causing converter 40 to rotate back to the off position when the user releases knob 42, thereby releasing the button and turning off the device.

Figure 3:
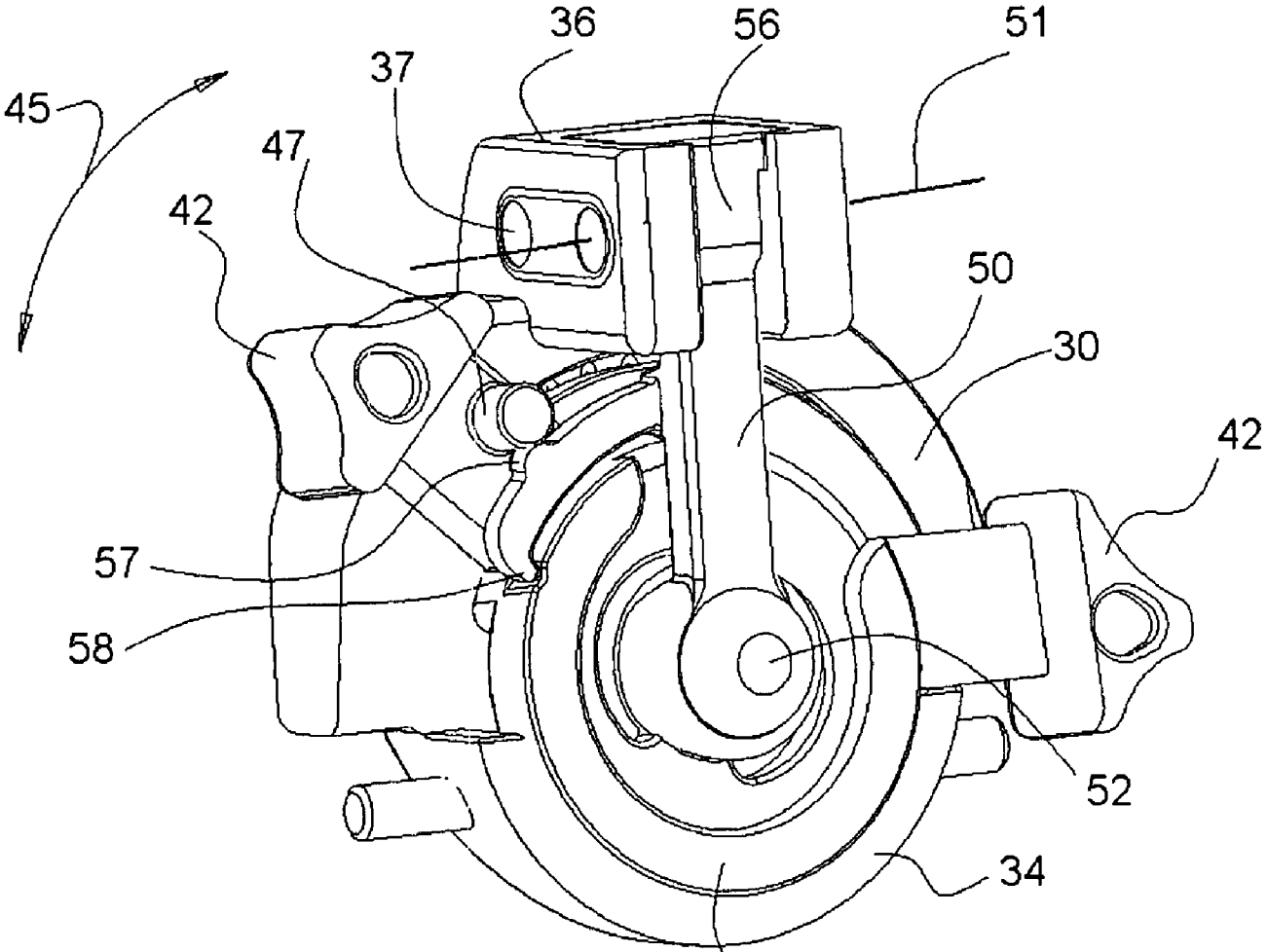

In the "on" position, as illustrated in FIG. 3, knob 42 is further rotated in the direction of arrow 45 to a point where it is retained by a releasable locking mechanism. Knob 42 may include, for example, a locking pin 47 and actuating assembly 50 may include a locking arm 56 on which there is a locking protrusion 57. As knob 42 is rotated over locking arm 56, locking pin 47 engages locking protrusion 57 and, as a result, converter 40 is secured. Rocker switch 3 may further include a locking depression 48 on converter 40 along with a locking projection 58 on locking arm 56 to ensure locking of knob 42 in position. Converter 40 may include a second locking depression (not shown) designed to lock knob 42 in its off position, to reduce the likelihood of inadvertent actuation of the accessory. Alternatively, any other locking mechanism may be utilized.

Figure 4:
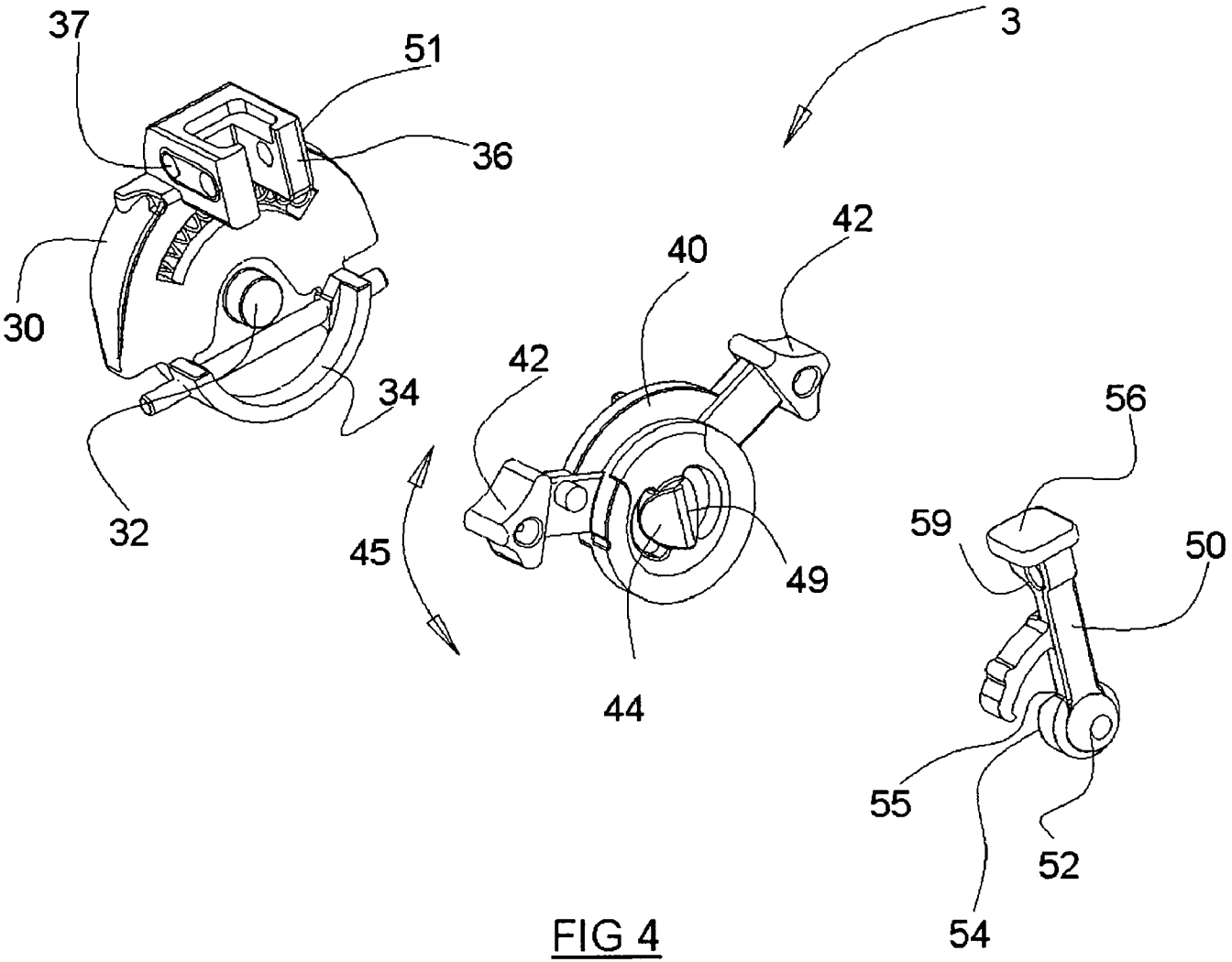
FIG. 4 is an exploded view of a rocker switch constructed and operative in accordance with a preferred embodiment of the present invention.

An exploded view of a rocker switch 3 according to a preferred embodiment of the invention is shown in FIG. 4. In this figure, like elements from FIG. 1 are noted by the same reference numerals. In this embodiment, base 30 includes an axle 32 positioned substantially at its center and an arced protrusion 34 concentric with axle 32, on its bottom. Base 30 further includes a hinge 36 to which actuating assembly 50 is pivotally coupled. Converter 40 seats on base 30, and it can be rotated about axle 32 with the support of arced protrusion 34. Converter 40 includes an angled portion 44, which defines a projecting ridge 49 of substantially triangular cross-section. Actuating assembly 50 includes a knob 52, whose rear side defines a V shaped groove 54 complementary to angled portion 44 on converter 40. Actuating assembly 50 further includes a hinge arm 56 for pivotally coupling it to hinge arm 36 of base 30. A pin (not shown) couples the two hinge arms through a cross hole 59 aligned with pin holes 37 and serves as a pivot axis 51.

When actuating assembly 50 is mounted on base 30 along with converter 40, an inside central line 55 defined in groove 54 on the back of knob 52 seats on the ridge 49 of angled portion 44. However, rotating knob 42 in the direction of arrow 45 will cause the ridge to rotate relative to the inside central line of groove 54, sliding along the sides of groove 54, resulting in linear movement of knob 52 away from base 30 as hinge arm 56 pivots relative to hinge 36.

Figure 5:
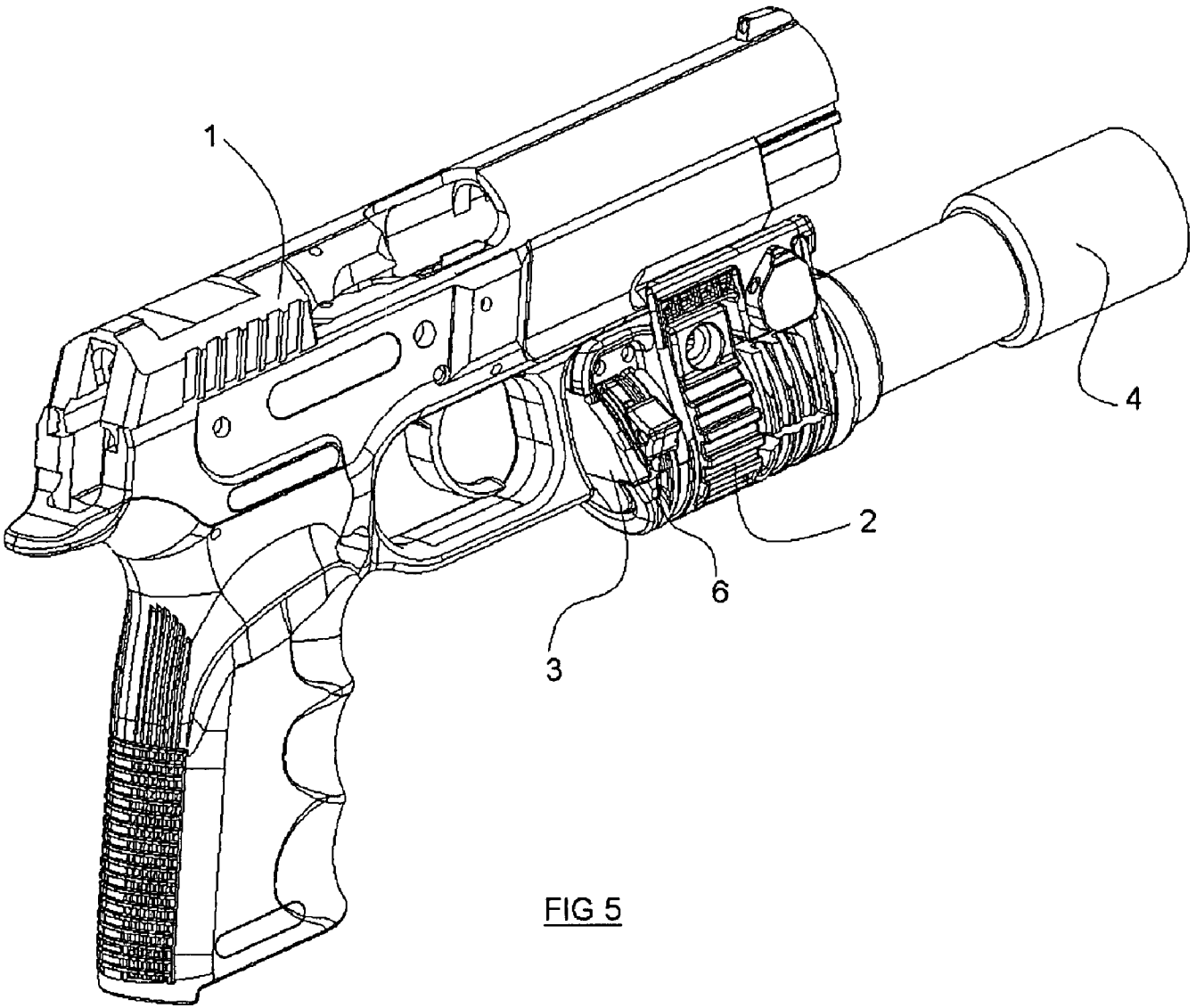
FIG. 5 is a perspective view of a rocker switch according to the invention, coupled to an accessory holder mounted on a handgun.

The rocker switch according to the invention can be mounted in an accessory holder for mounting on a hand gun, camera, or the like. FIG. 5 is a perspective view of a rocker switch 3 coupled to an accessory holder 2 mounted on a handgun. An electrical accessory, here illustrated as a flashlight 4, is mounted in holder 2 for actuation by rocker switch 3. The flashlight can easily be turned on and off with the rocker switch 3, using one finger. It will be appreciated that, since there is a knob 6 on each side of holder 2, the rocker switch 3 can be operated by either hand of a user.

Figure 6:
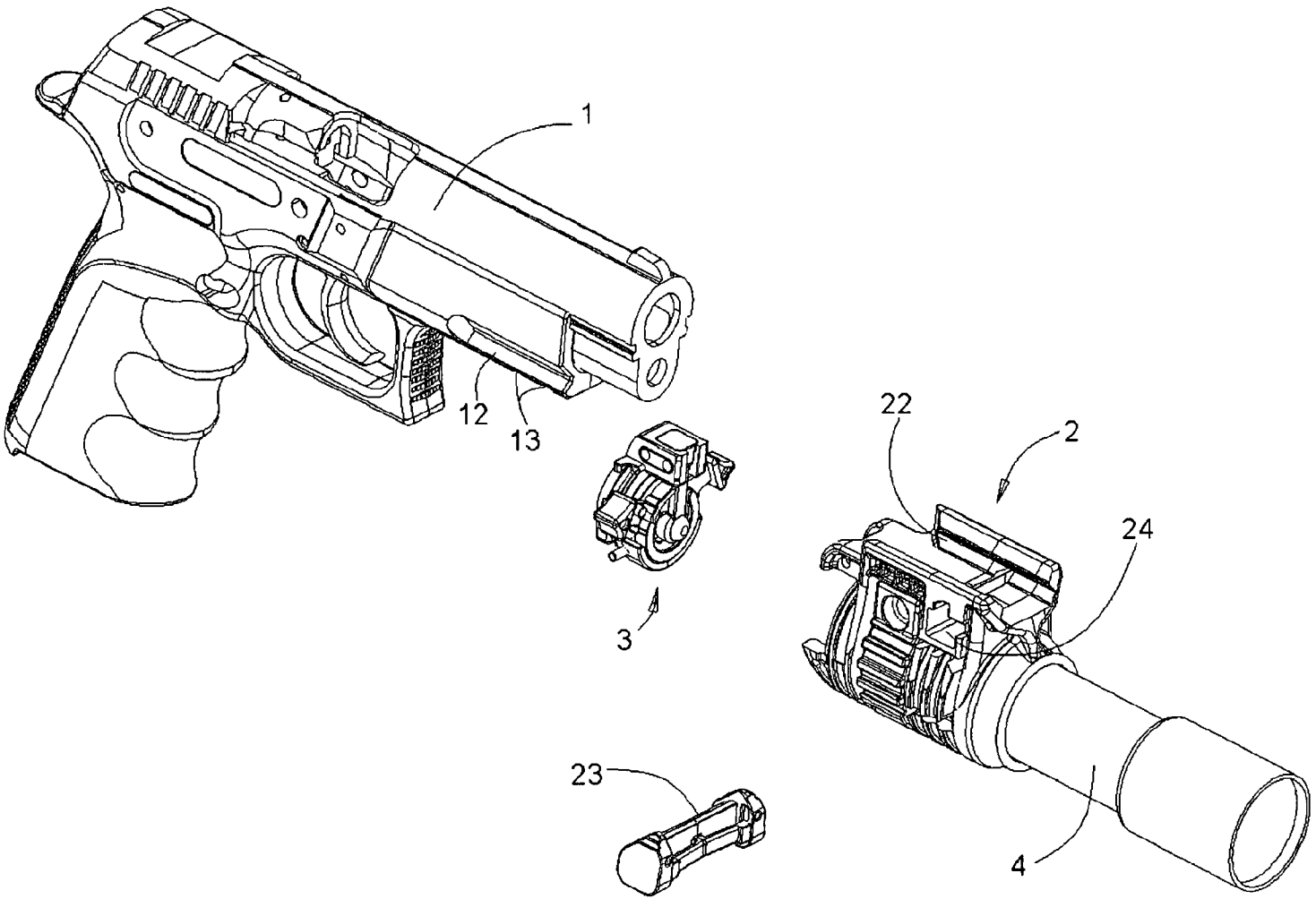
FIG. 6 is an exploded view of the accessory holder of FIG. 5.

In FIG. 6, there is shown an exploded view of the accessory holder of FIG. 5. In this preferred embodiment, accessory holder 2 is mounted on the handgun by means of a standard mounting rail 12, which may form an integral part of handgun 1, such as a Weaver or Picatinny Rail, and a complementary rail 22 on accessory holder 2. Preferably, accessory holder 2 includes a locking element 23, which serves to couple the holder 2 to handgun 1, as through a locking bore 24 aligned with locking slits 13 in mounting rail 12.

Figure 7:
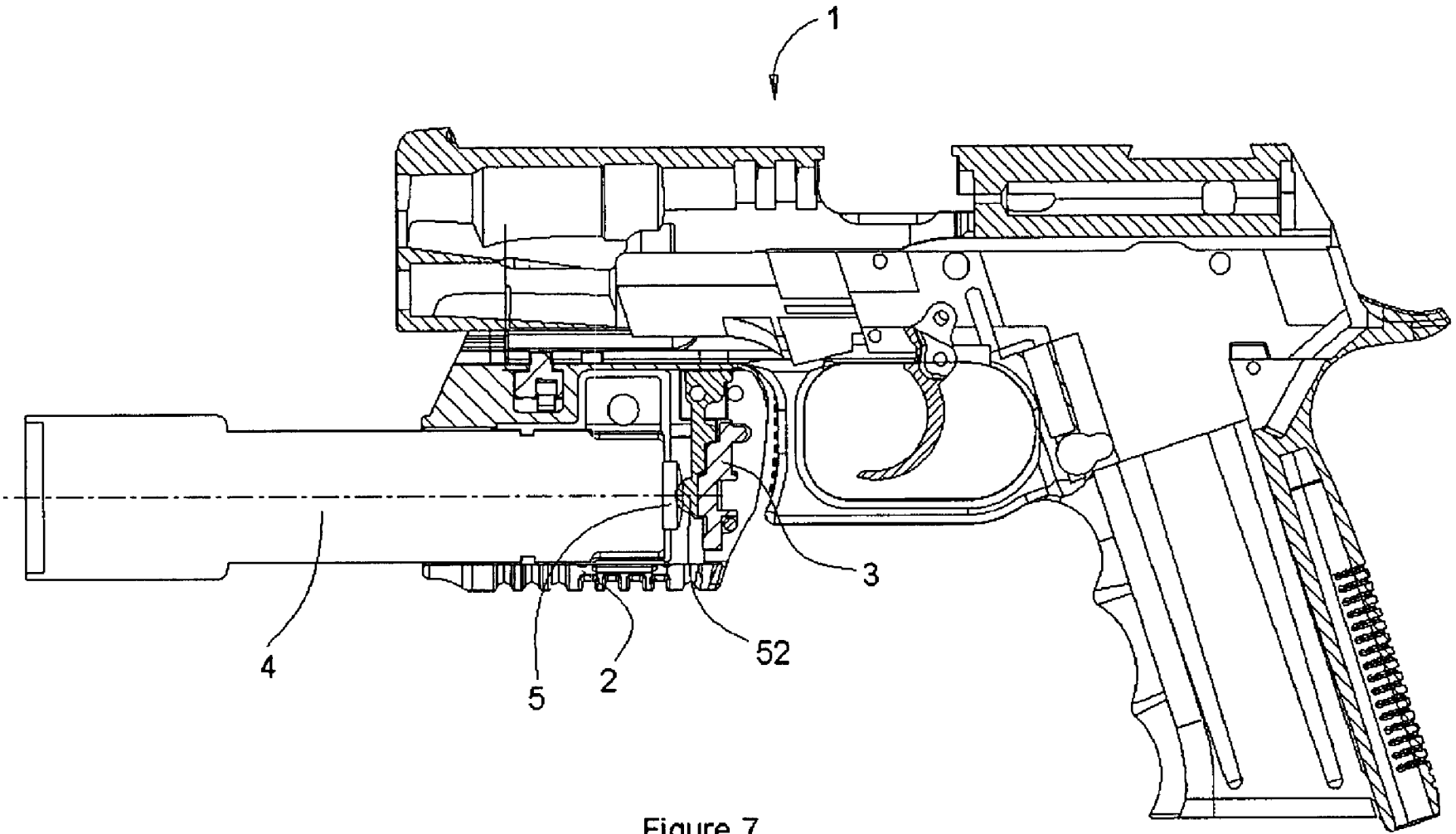
FIGS. 7 and 8 are side sectional views of the rocker switch of FIG. 4, mounted in an accessory holder, in two different positions of operation.
Figure 8:
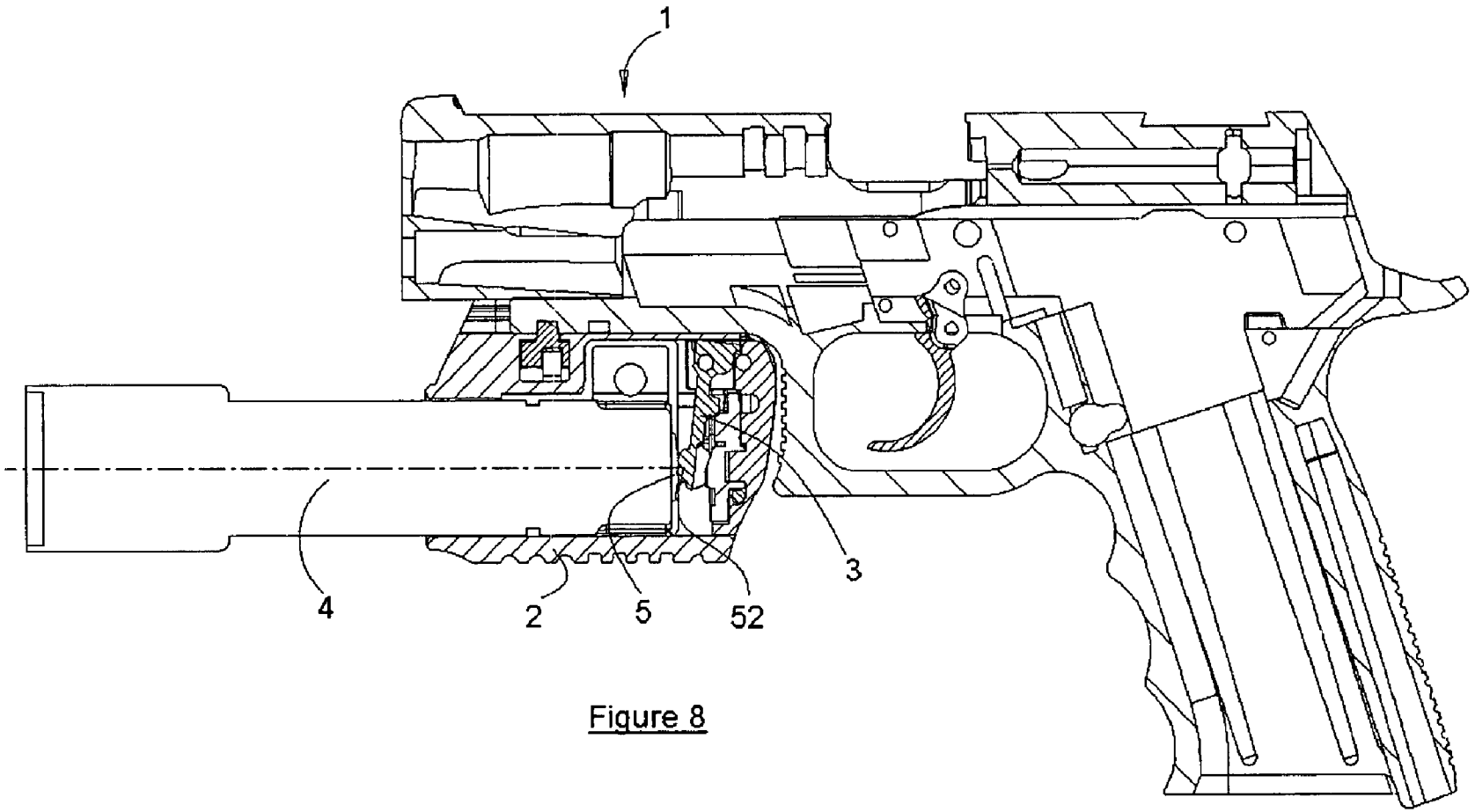

FIGS. 7 and 8 are side sectional views of a rocker switch according to the embodiment of FIG. 4, mounted in an accessory holder 2 on a handgun 1, in two different positions of operation. An electrical accessory, here illustrated as a flashlight 4, is mounted in holder 2. Flashlight 4 has a push button actuator 5 on its rear side, which is disposed adjacent rocker switch 3. As knob 52 is pushed forward, push-button 5 is activated, as shown in FIG. 8, thereby turning on flashlight 4.

Accessory holder 2 can be used with any accessory that includes a simple contact switch on its rear side. Thus, flashlight 4 can be replaced by a different flashlight, a laser pointer or any other desired electric device.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. An accessory holder comprising:

a holder for a removable electric accessory having a mechanically actuable switch thereon; and a rocker switch mounted in said accessory holder for actuating said switch of an accessory replaceably mounted in said holder;

said rocker switch comprising:

a base;

a rotary to linear converter mounted on the base, said rotary to linear converter being rotatable by means of at least one knob; and an actuating assembly mounted on the rotary to linear converter and arranged to actuate said switch when said knob is rotated.

2. The accessory holder according to claim 1 further comprising a mounting rail for mounting on a device.

3. The accessory holder according to claim 1, wherein said mechanically actuable switch includes a rear contact switch engageable by said actuating assembly.

4. The accessory holder according to claim 1, further comprising a releasable locking mechanism for locking said rotary to linear converter in an "on" or "off" position.

5. The accessory holder according to claim 1, wherein said knob rotates said rotary to linear converter in a first plane, causing said actuating assembly to move linearly in a second plane perpendicular to said first plane so as to actuate said switch.

6. An accessory holder comprising:

a holder for a replaceable electric accessory; and a rocker switch mounted in said accessory holder for turning on and off an accessory replaceably mounted in said holder a base;

wherein said rocker switch comprises:

a rotary to linear converter mounted on the base, said rotary to linear converter being rotatable by means of at least one knob mounted thereon, and includes an angled portion which defines a projecting ridge of substantially triangular cross-section; and an actuating assembly pivotally coupled to said base and defining a V-shaped groove complementary to said projecting ridge, wherein, when said knob is rotated, said projecting ridge rotates and slides along the sides of said groove causing said actuating assembly to actuate said replaceable accessory.

7. The rocker switch according to claim 6, wherein said actuating assembly includes a hinge arm coupled to said base, defining a pivot.

8. The accessory holder according to claim 6 further comprising a mounting rail for mounting on a device.

9. The accessory holder according to claim 6, wherein said mechanically actuable switch includes a rear contact switch engageable by said actuating assembly.

10. The accessory holder according to claim 6, further comprising a releasable locking mechanism for locking said rotary to linear converter in an "on" or "off" position.

11. A method for forming an accessory holder, the method comprising:

forming a holder for a removable electric accessory having a mechanically actuable switch thereon; and mounting a rocker switch in said accessory holder for actuating said switch of an accessory replaceably mounted in said holder;

said rocker switch comprising:

a base;

a rotary to linear converter mounted on the base, said rotary to linear converter being rotatable by means of at least one knob; and an actuating assembly mounted on the rotary to linear converter and arranged to actuate said switch when said knob is rotated.

12. The method according to claim 11, wherein said step of mounting includes:

mounting said rotary to linear converter for rotation in a first plane; and mounting said actuating assembly on said rotary to linear converter for linear movement in a second plane perpendicular to said first plane so as to actuate said switch.

13. The method according to claim 11, wherein the step of mounting a rocker switch comprises:

providing a base;

mounting a rotary to linear converter on said base, said rotary to linear converter being rotatable by means of at least one knob mounted thereon, defining on said rotary to linear converter an angled portion which defines a projecting ridge of substantially triangular cross-section; and pivotally coupling an actuating assembly on said base, defining in said actuating assembly a V-shaped groove complementary to said projecting ridge;

and mounting said actuating assembly on said rotary to linear converter so that said projecting ridge can rotate and slide along the sides of said groove and cause said actuating assembly to actuate an electric device when said knob is rotated.

14. The method according to claim 13, further comprising coupling a hinge arm to said base for pivoting relative to said base during rotation of said knob.

15. The method according to claim 13, further comprising mounting said rocker switch in an accessory holder holding an accessory having a rear switch, said actuating assembly being disposed adjacent said rear switch for selective actuation thereof upon rotation of said knob.

* * * * *